US009045888B2

(12) United States Patent
Stauber et al.

(10) Patent No.: US 9,045,888 B2
(45) **Date of Patent: *Jun. 2, 2015**

(54) TOILET FLUSHING ASSEMBLY AND SEQUENCE

(71) Applicant: Kohler Co., Kohler, WI (US)

(72) Inventors: Joseph Stauber, Sheboygan Falls, WI (US); Peter W. Denzin, Glenbeulah, WI (US); Benjamin Marotz, Kohler, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/059,906

(22) Filed: Oct. 22, 2013

(65) Prior Publication Data

US 2014/0041109 A1 Feb. 13, 2014

Related U.S. Application Data

(63) Continuation of application No. 12/619,760, filed on Nov. 17, 2009, now Pat. No. 8,566,971.

(51) Int. Cl.

| | |
|---|---|
| ***E03D 11/10*** | (2006.01) |
| ***E03D 3/12*** | (2006.01) |
| ***E03D 5/012*** | (2006.01) |
| ***E03D 5/10*** | (2006.01) |
| ***E03D 9/00*** | (2006.01) |

(52) U.S. Cl.

CPC *E03D 3/12* (2013.01); *E03D 5/012* (2013.01); *E03D 5/10* (2013.01); *E03D 9/00* (2013.01); *E03D 11/10* (2013.01)

(58) Field of Classification Search

USPC ..... 4/415, 427, 434–442

See application file for complete search history.

(56) References Cited

U.S. PATENT DOCUMENTS

| | | | |
|---|---|---|---|
| 383,858 | A | 6/1888 | Campbell |
| 1,281,457 | A | 10/1918 | Whitney |

(Continued)

FOREIGN PATENT DOCUMENTS

| | | |
|---|---|---|
| CN | 1036240 | 10/1989 |
| CN | 2727262 | 9/2005 |

(Continued)

OTHER PUBLICATIONS

Australian Provisional Patent App. No. 2009900129: Waterless Toilet, filing date of Jan. 14, 2009, Supplement to the Australian Official Journal of Patents, vol. 23, No. 4, Jan. 29, 2009, p. 6413.

(Continued)

*Primary Examiner* — Tuan N Nguyen

(74) *Attorney, Agent, or Firm* — Foley & Lardner LLP

(57) ABSTRACT

A toilet has an electronic flush assembly operable in either a short or long flush sequence selectable by a user. The long flush sequence includes a pre-rinse cycle and a rinse cycle in which the a supply valve and a flush valve are both opened and closed twice, once each first during the pre-rinse cycle and again during a subsequent rinse cycle. The rim supply valve and the flush valve are opened during the pre-rinse and rinse cycles but are closed at the start and end of each cycle. An electronic control controls operation of the valves as well as water supply control components. Level sensors can also be included to provide feedback to the controller, for example, to prevent overflow conditions.

20 Claims, 7 Drawing Sheets

(56) References Cited

U.S. PATENT DOCUMENTS

| | | | |
|---|---|---|---|
| 2,715,228 | A | 8/1955 | McLanahan |
| 5,305,475 | A | 4/1994 | Jaeckels et al. |
| 5,548,850 | A | 8/1996 | Geeham |
| 5,873,136 | A | 2/1999 | Geeham |
| 5,940,899 | A | 8/1999 | Mankin et al. |
| 6,332,229 | B1 | 12/2001 | O'Malley et al. |
| 6,502,251 | B1 | 1/2003 | Teshima et al. |
| 6,671,893 | B1 | 1/2004 | Quintana et al. |
| 6,782,564 | B1 | 8/2004 | Cheng |
| 6,998,552 | B1 | 2/2006 | Li |
| 8,418,277 | B2 | 4/2013 | Okubo et al. |
| 2005/0022292 | A1 | 2/2005 | Choi |
| 2005/0028260 | A1 | 2/2005 | Ling |
| 2006/0168716 | A1 | 8/2006 | Schuster et al. |
| 2008/0047053 | A1 | 2/2008 | Grech et al. |
| 2008/0072372 | A1 | 3/2008 | Jorsch |
| 2008/0276362 | A1 | 11/2008 | O'Malley |

FOREIGN PATENT DOCUMENTS

| | | |
|---|---|---|
| CN | 2937265 | 8/2007 |
| DE | 10109152 | 9/2002 |
| EP | 1156166 | 11/2001 |
| JP | 09-256448 | 9/1997 |
| JP | 2009-256448 | 9/1997 |
| JP | 09-287187 | 11/1997 |
| JP | 2009-287187 | 11/1997 |
| JP | 2007-023492 | 2/2007 |
| JP | 2009-074362 | 4/2009 |
| KR | 10-2009-0061625 | 6/2009 |
| WO | WO9934067 | 7/1999 |
| WO | WO0244483 | 6/2001 |
| WO | WO03058102 | 7/2003 |
| WO | WO03087641 | 10/2003 |

OTHER PUBLICATIONS

Australian Provisional Patent App. No. 2010900095: Evolute Toilet, filing date of Jan. 13, 2010, Supplement to the Australian Official Journal of Patents, vol. 24, No. 4, Jan. 28, 2010, p. 320.

Coxworth, Ben, Evolute —the near-waterless toilet, www.gizmag.com, Feb. 25, 2010.

New Inventors: Evolute, www.abc.net.au/tv/newinventors/txt/s2811696.htm, Feb. 26, 2010.

Three pages of an ISR from the corresponding PCT/US2010/056136, mailed Mar. 1, 2011.

TOILET FLUSHING ASSEMBLY AND SEQUENCE

CROSS-REFERENCE TO RELATED PATENT APPLICATIONS

The present application is a continuation of U.S. application Ser. No. 12/619,760, filed Nov. 17, 2009, which is incorporated herein by reference in its entirety.

BACKGROUND

The present invention relates to plumbing fixtures such as toilets. In particular, the present invention relates to the flush assembly and flush sequencing for toilets.

Conventional toilets utilize a single mechanical flush sequence to evacuate waste from the toilet bowl, rinse the bowl, and possibly to refill a water tank. Simple mechanical components such as gravity operated flapper valves and float controlled fill valves are normally used to control the passage of water through the bowl and the filling of the tank. The trade-off for such a simple mechanical flush assembly is wasted water consumption in low waste conditions and inadequate or inconsistent rinsing of the bowl in high waste conditions.

Over time there have been numerous revisions and improvements made to the conventional toilet. For example, several toilets have been devised with electronically controllable flush, rinse and fill components, see e.g., U.S. Pat. Nos. 5,548,850 and 6,332,229. These patents also disclose toilets with alternate flush sequences. And, more forceful rinsing action has been achieved using jet components, such as disclosed by U.S. Pat. No. 2,715,228. However, as of yet the flush control components and sequencing of conventional toilets has often been insufficient to achieve an efficient and adequate flush in varied waste load conditions.

There is thus a need for toilets with advanced flush assemblies and sequencing to better address problems with known toilets.

SUMMARY

In one aspect the invention provides a toilet having a bowl with a bowl outlet and a rim having a rim outlet. A flush valve operates to control flow through the bowl outlet. A rim supply valve operates to control flow into the bowl rim. The toilet flushes water through the bowl during a flush sequence in which the rim supply valve and the flush valve are both opened and closed twice, first during a pre-rinse cycle and subsequently during a rinse cycle. The rim supply valve and the flush valve are closed at the beginning and end of the cycles and open therebetween.

In another aspect the invention provides a toilet as described that is selectively operable in first and second flush sequences. The first flush sequence includes a pre-rinse cycle in which the toilet flushes water through the bowl by opening and closing the rim supply valve and the flush valve once. The second flush sequence includes the pre-rinse cycle and a rinse cycle in which the rim supply valve and the flush valve are both opened and closed twice, first during the pre-rinse cycle and subsequently during the rinse cycle.

In still another aspect the invention provides a flush sequence for a toilet which includes initiating a pre-rinse cycle and subsequently initiating a rinse cycle for the same flush event. The pre-rinse cycle includes opening the supply valve to flow water to the rim and pass water through the rim outlet into the bowl, opening the flush valve to empty the bowl through the bowl outlet, and closing the flush valve. The rinse cycle includes opening the supply valve to flow water to the rim and pass water through the rim outlet to the bowl, opening the flush valve to evacuate the bowl through the bowl outlet, and closing the flush valve and the supply valve.

To improve flush performance, the flush sequence, particularly the rinse cycle, can further include using an eductor to increase the flow rate of rinse water into the bowl.

Additionally, the toilet can include an electronic control which controls the open and close operation of the flush valve and the rim supply valve. In addition to the rim water supply, the electronic control can control filling and output flow from a reservoir water supply, such as toilet tank. And, level sensors, such as mounted in the bowl and/or the water supply reservoir, can be coupled to the electronic control for sending bowl and reservoir level input signals to the electronic control, and thereby control fill levels in both.

Hence, the invention provides an advanced electronically controlled toilet which provides an improved flush. To save water in low-waste conditions, the toilet can be operated in a quick or short flush mode, in which the bowl is briefly rinsed by water from the bowl rim. For higher waste conditions, the user can select a long or dual rinse mode in which the bowl is pre-rinsed with water from the rim to empty the waste and then rinsed again, this time with rim water which may be eductor-assisted. To do this, the electronic control opens and closes the rim supply valve and the bowl flush valve one time during the pre-rinse cycle and a second time during the regular rinse cycle. Thus, fully opening and closing these valves twice during a single flush event. Additional electronic control and sensing can be provided to further automate and regulate the flushing operation.

The foregoing and still other advantages of the invention will appear from the following description. In that description reference is made to the accompanying drawings which form a part hereof and in which there is shown by way of illustration a preferred embodiment of the invention.

DETAILED DESCRIPTION

Referring now to FIGS. 1-5, a toilet 10 is shown that is configured to have two flushing sequences. Although the specifics of the flushing sequences will be described in more detail below, an overview of the components of the toilet 10 and their connectivity will be described first to provide a structural context for the flushing sequences. Although a two-part modular construction is shown, it should be appreciated that the toilet 10 need not be of a modular design and could be of a more conventional toilet assembly. Accordingly, the modular assembly is only one example of a toilet that may utilize the flushing sequences described below.

Figure 1:
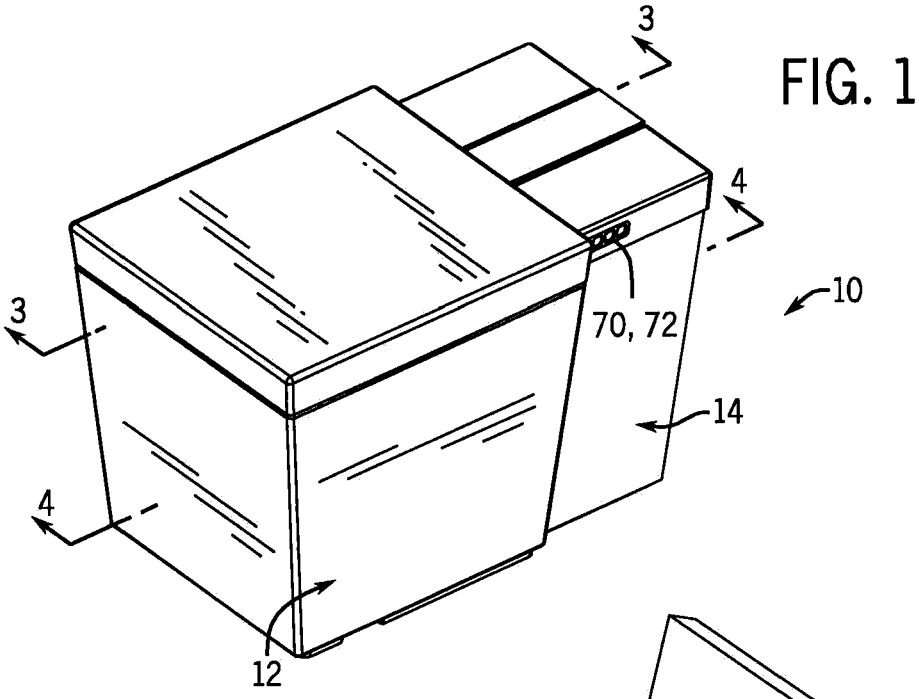
FIG. 1 is a perspective view of a toilet according to the present invention with its lid down.
Figure 2:
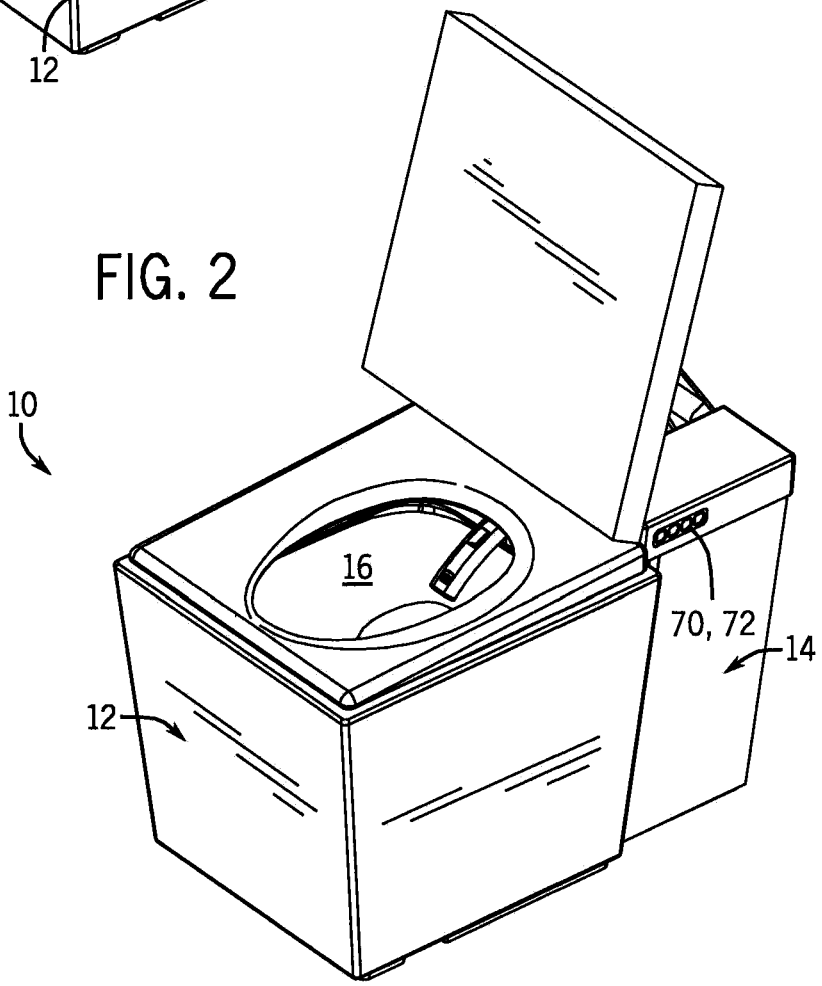
FIG. 2 is a perspective view of the toilet of FIG. 1 with its lid up.
Figure 3:
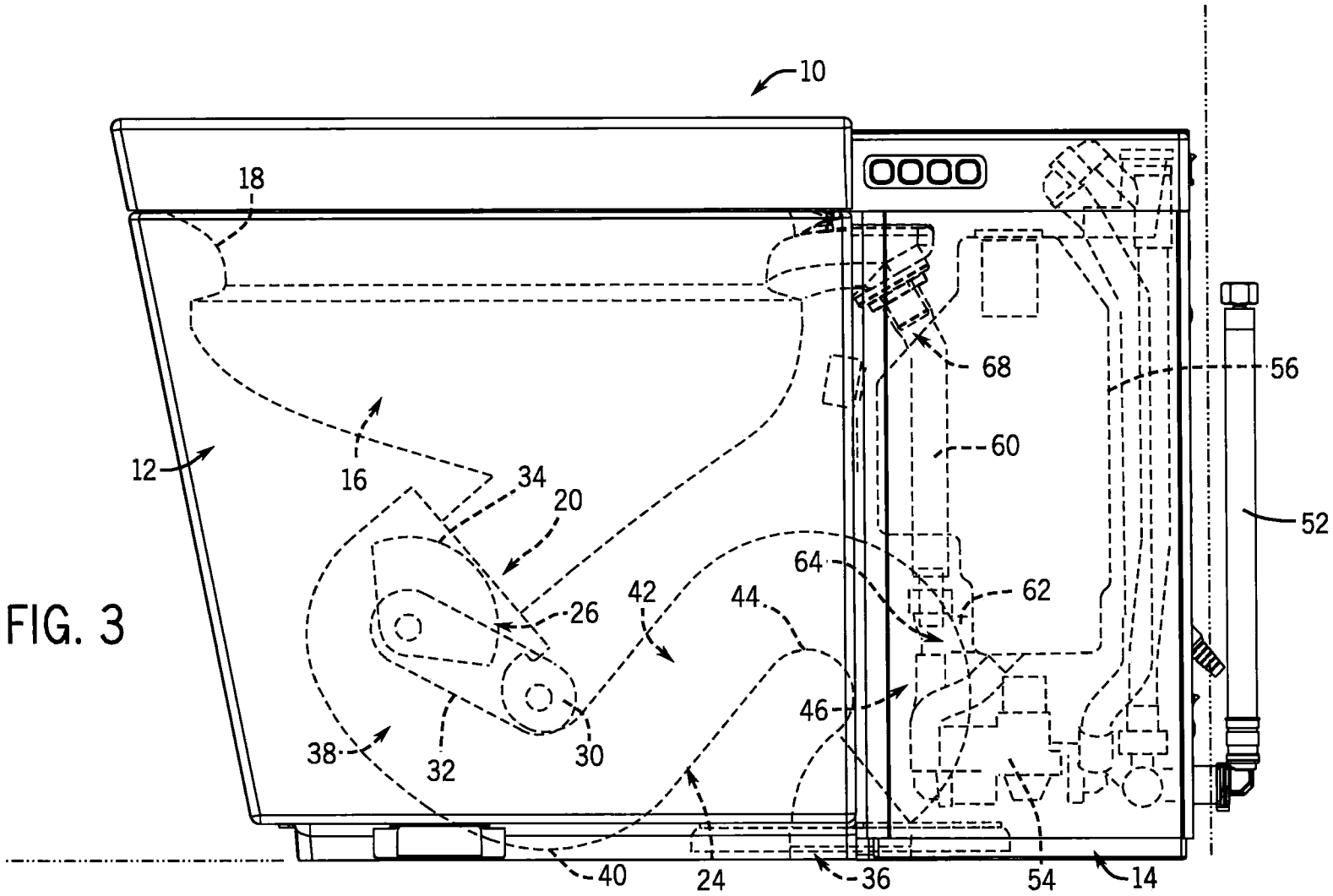
FIG. 3 is a side view of the toilet with the bowl, the trapway, and the plumbing components shown in phantom lines.
Figure 4:
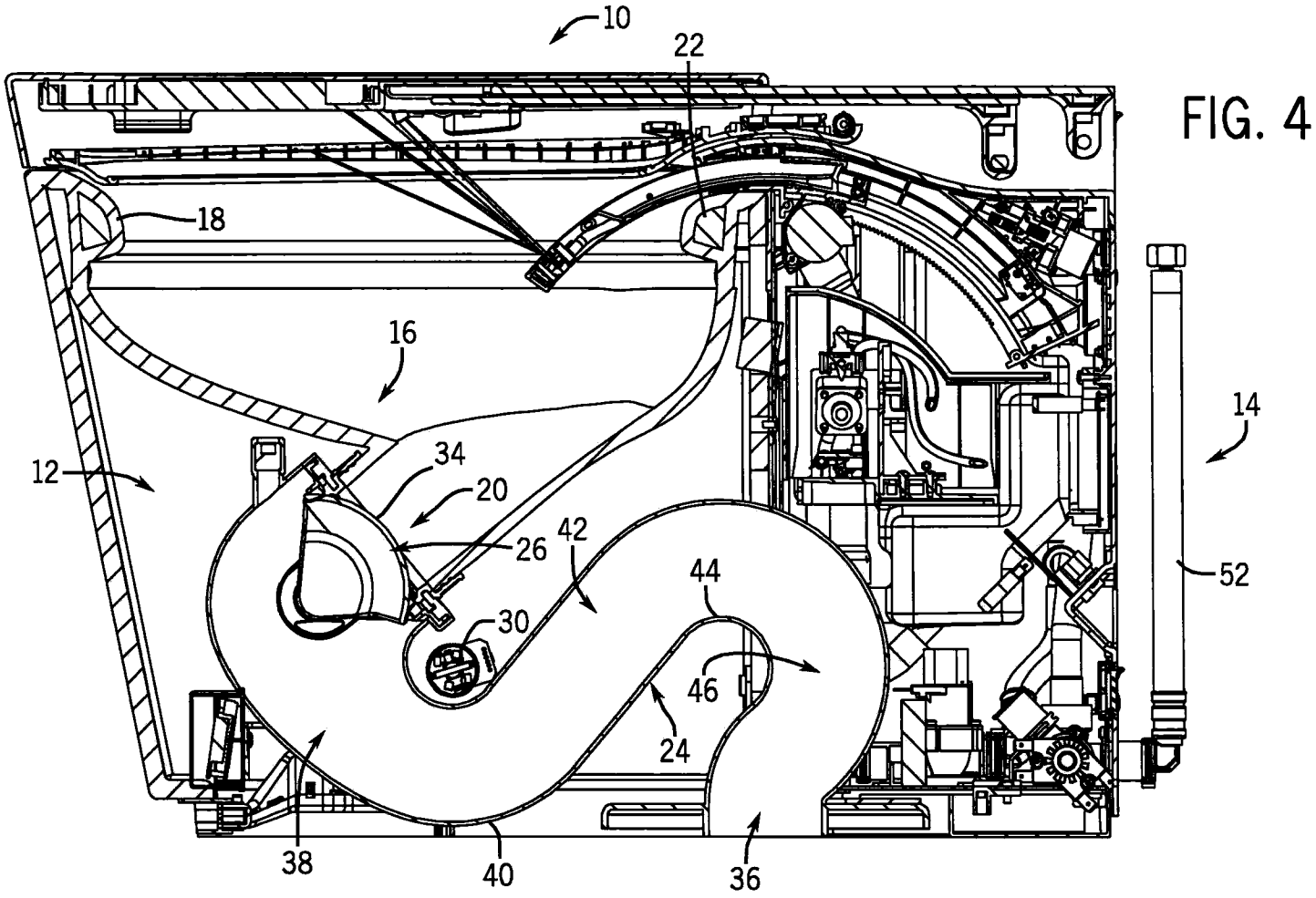
FIG. 4 is a cross-sectional side view of the toilet taken along line 4-4 of FIG. 1.

As best seen in FIGS. 1 and 2, the toilet 10 includes a frontal basin portion 12 and a rear backpack portion 14. In the embodiment shown, the toilet 10 is designed to be a modular assembly in which, generally speaking, the rear backpack portion 14 supports and/or houses many of the functional components of the toilet 10 while the frontal basin portion 12 is one of several possible front-side attachments which is adapted to be connected to the rear backpack portion 14. As different front-side attachments may be made, the toilet 10 can take on various appearances using a single rear backpack portion 14. Moreover, the rear backpack portion 14 may be configurable to receive various components that provide accessory functions to the toilet such as a bidet wand, automatic seat and/or lid lifting mechanisms, air circulating functions, music accessories, and so forth.

The frontal basin portion 12 includes a bowl 16 extending from a bowl rim 18 at the top of the bowl 16 to a bowl opening 20 proximate the bottom of the bowl 16. The bowl rim 18 includes a channel 22 (best seen in FIG. 4) which selectively receives water which may then be directed into the bowl 16 during a flushing sequence via apertures or rim openings in an underside of the bowl rim 18. The bowl opening 20 may be placed in selective communication with a trapway 24 by a flush valve 26 that is located therebetween.

Figure 7:
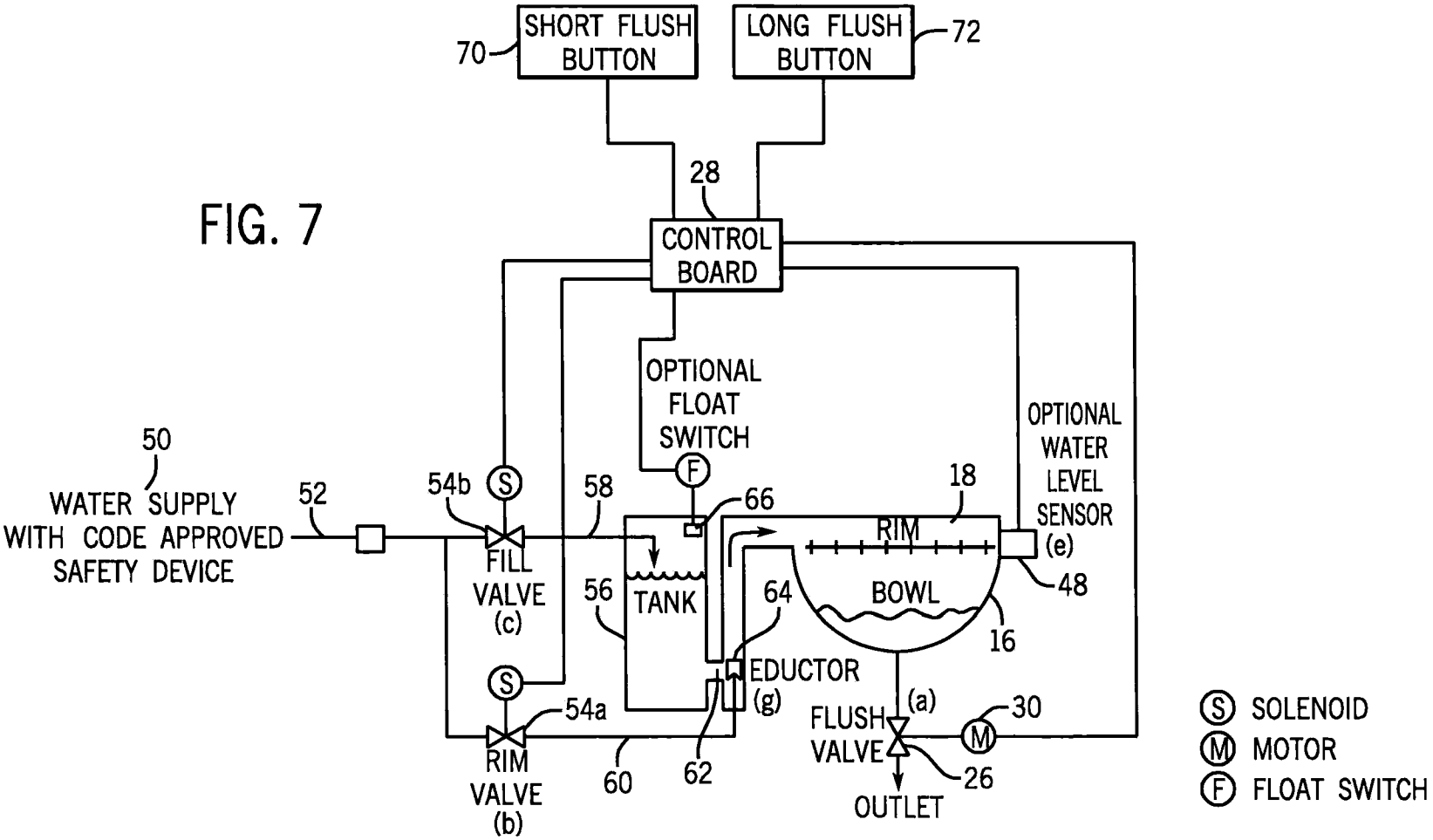
FIG. 7 is a simplified schematic of the plumbing of the toilet of FIG. 1.

The flush valve 26 is electromechanically controlled by a control board 28 (e.g., a controller or electrical control, and as schematically illustrated in FIG. 7) which is located in the rear backpack portion 14 of the toilet 10. This control board 28 is electronically coupled to a motor 30 which is mechanically coupled to the flush valve 26 via a linkage 32 such as a belt or a chain. When the motor 30 drives the linkage 32, the flush valve 26 may be actuated from an open position to a closed position or vise-versa. In the closed position, shown in FIGS. 3 and 4, an arcuate surface 34 of the flush valve 26 forms a seal about the bowl opening 20 at the bottom of the bowl 16 such that any water and waste contents located in the bowl 16 are substantially retained in the bowl 16. Then, in the open position (not shown), the flush valve 26 is rotatably actuated from the close position to remove the seal between the bowl 16 and the trapway 24 such that the contents of the bowl 16 can pass from the bowl 16 into the trapway 24 such as during a flushing operation. Although a flush valve 26 that is rotatable is shown, other types of valves could also be used to selectively place the bowl 16 in fluid communication with the trapway 24.

The trapway 24 is a tube-like passage that snakes under the bowl 16 and rearwards in a sideways S-shape from the bowl opening 20 to a trapway end 36 which connects to an opening in the floor which connects to a waste line pipe (not shown) or the like. The geometry of the trapway 24 is such that a first leg 38 of the trapway 24 proximate the flush valve 26 extends downward to a dip 40, a second leg 42 of the trapway 24 extends upward from the dip 40 to a weir 44, and a third leg 46 of the trapway 24 extends downward from the weir 44 to connect to the opening in the floor. To prevent the escape of trapped sewer gases from the waste water line into the bowl 16 (and into the atmosphere surrounding the toilet 10), water may be captured in the space between the dip 40 and the weir 44 to form a water seal in the trapway 24.

A water level sensor 48 (schematically illustrated in FIG. 7) may also be coupled to the bowl 16 to detect a level of the water in the bowl 16. The water level sensor 48 may be electronically coupled to the control board 28 to indicate the current state of water in the bowl 16 (e.g., a water level of the bowl 16) via a signal. The water level sensor 48 may be utilized to detect the water level in the bowl 16 and to stop the feeding of water to the bowl 16 during a flush sequence during a fill step or in the event that a blockage in the trapway 24 or the like prevents water from emptying from the bowl 16.

Figure 5:
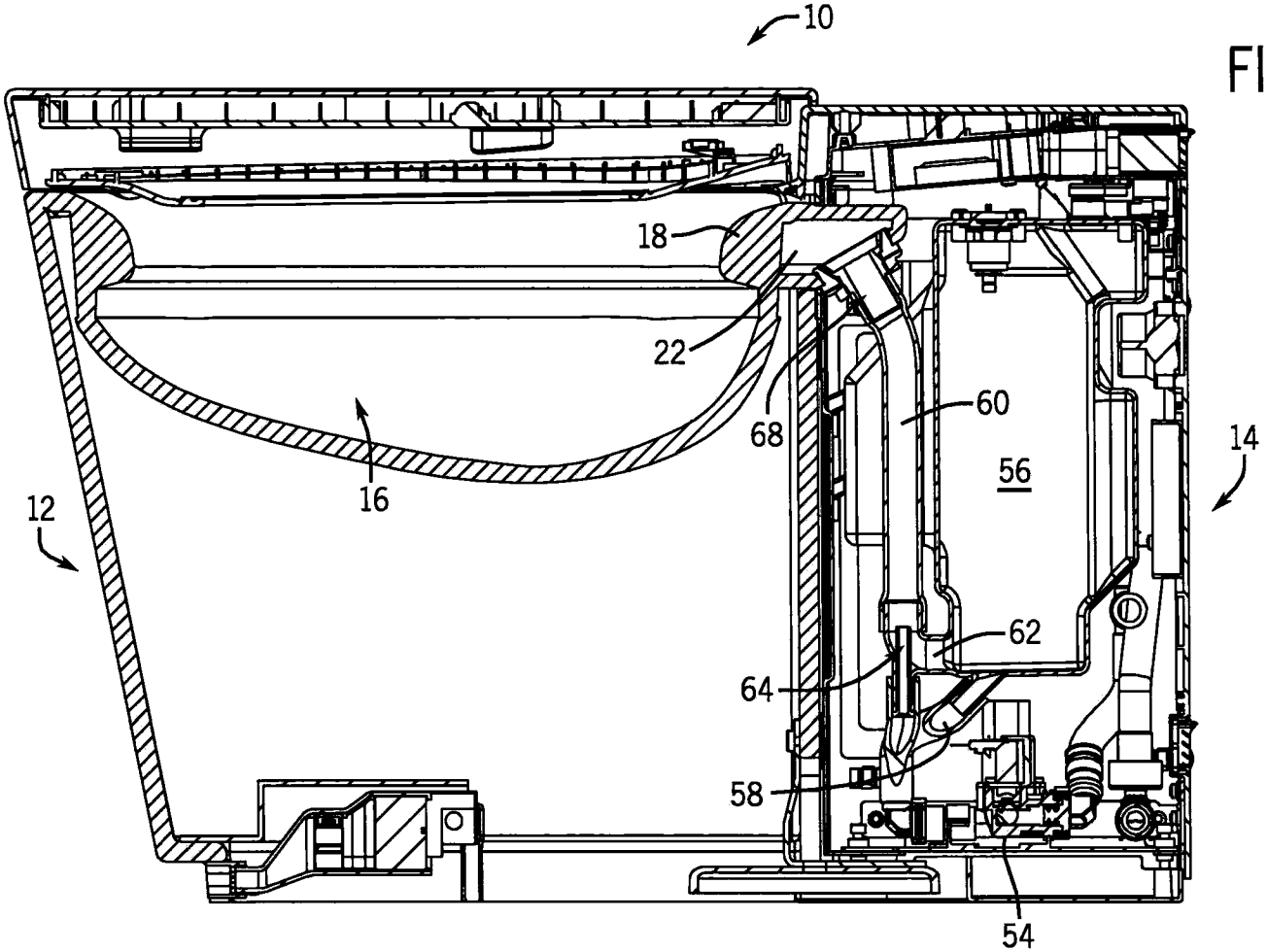
FIG. 5 is a cross-sectional side view of the toilet taken along line 5-5 of FIG. 1.
Figure 6:
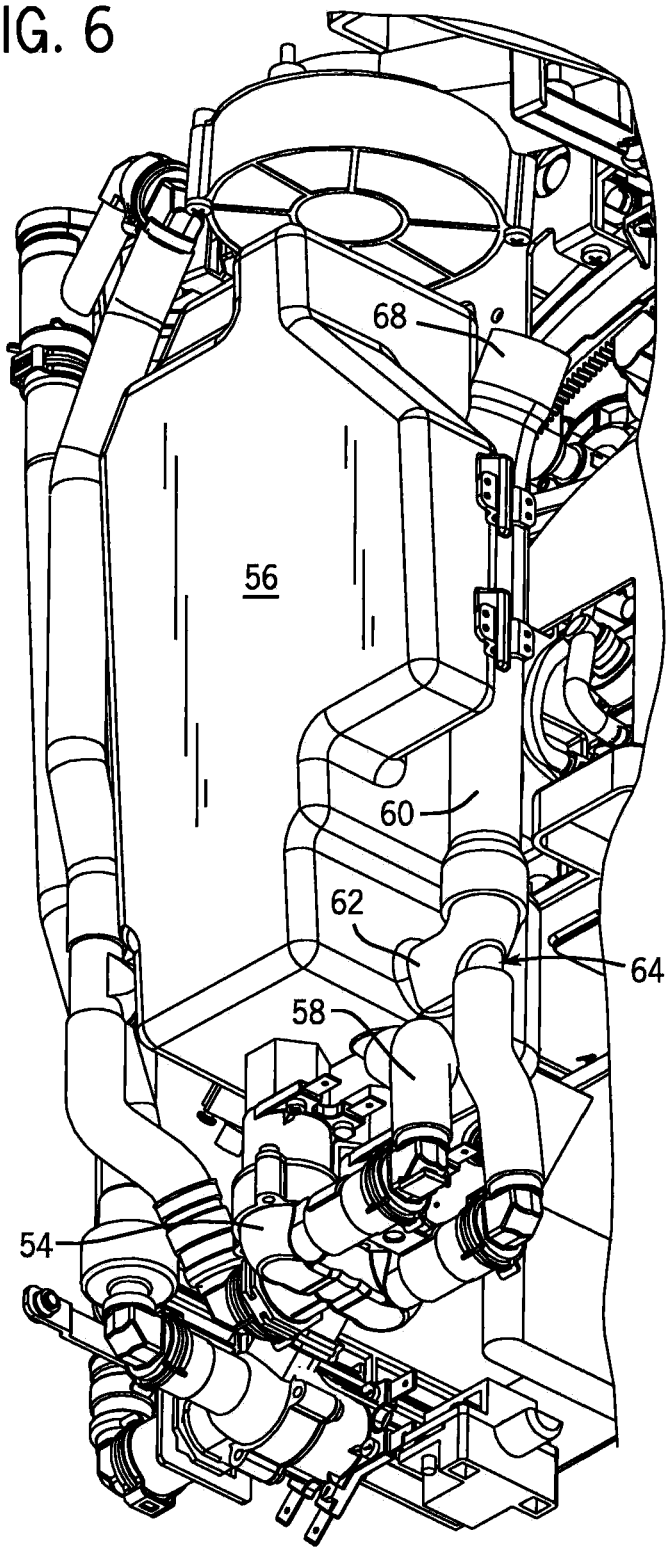
FIG. 6 is a front lower left side view of some of the internal plumbing components of the toilet of FIG. 1.

Now with additional reference to FIGS. 5, 6, and 7, the rear backpack portion 14 supports and houses the plumbing utilized in performing the flushing sequences. Beginning at the source, a water supply 50 (illustrated schematically in FIG. 7) provides water to the other plumbing components. The water supply 50 is connected with the toilet 10 via an inlet line 52 that comes in from the behind the rear backpack portion 14 of the toilet 10. The inlet line 52 is connected to a solenoid valve 54. The solenoid valve 54 may be electronically controlled by the control board 28, to selectively place the inlet line 52 in fluid communication with a tank 56 via a tank fill line 58 (i.e., a filler) or the bowl rim 18 via a rim line 60. The rim line 60 is placed in fluid communication with the bowl rim 18 via a spud connection or the like at an end 68 of the rim line 60. Although a single solenoid valve 54 is shown in FIGS. 3 to 6, a separate rim supply valve 54*a* and fill valve 54*b* may also be used as illustrated in the schematic of FIG. 7.

Notably, the tank 56 (or water supply reservoir) is also placed in communication with the rim line 60 via an eductor line 62 which connects to the rim line 60 to form an eductor 64. This eductor 64 may assist in providing a particularly strong flow of water to the rim 18 when water from the tank 56 supplements the water being supplied via the rim line 60.

Additionally, a float switch 66 may be located in the tank 56. When the water level in the tank 56 exceeds a pre-determined threshold level, typically causing a portion of the float switch 66 to rise within the tank 56, this displacement of a portion of the float switch 66 may cause the closing of a shutoff valve (possibly either by a direct mechanical connection between the float switch 66 and the shutoff valve or by a sending an electrical signal to the control board 28 which operates the shutoff valve) which temporarily closes off the water supply 50 from the other plumbing components.

With reference to FIG. 7, a summary of the connectivity of the control board 28 to the various components may be made. With respect to the bowl 16, the control board 28 may be electrically coupled to the water level sensor 48 and the motor 30 that controls the open or closed state of flush valve 26. With respect to the plumbing components in the rear backpack portion 14, the control board 28 is electrically coupled to the solenoid valve 54 (illustrated in FIG. 7 as separate rim supply valve 54*a* and fill valve 54*b*) which controls the flow of water from the water supply 50 into the tank 56 and into the rim 18. Further, the control board 28 may receive a status of the state of the water level in the tank 56 via the float switch 66. Although not previously described, the control board 28 is also electronically coupled to a short flush button 70 and a long flush button 72. Of course, rather than being buttons, these could be any of a number of types of controls, switches, buttons, or the like. The short flush button 70 and the long flush button 72 may be used to start a short flushing sequence or a long flushing sequence that will now be described.

Figure 8:
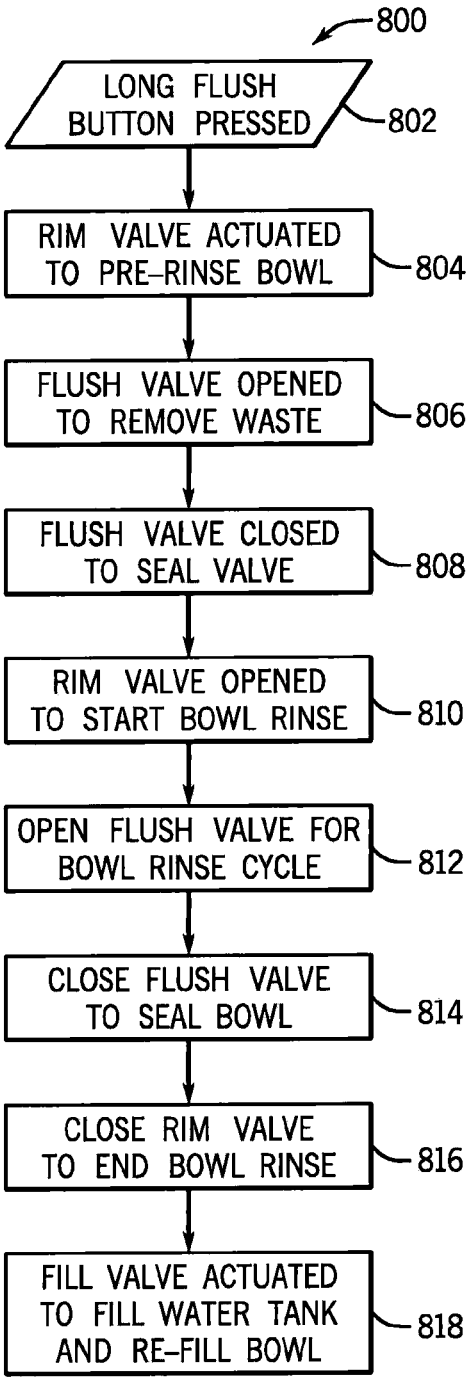
FIG. 8 is a process chart of a long flush sequence for the toilet of FIG. 1.

Referring now to FIG. 8, a long flush sequence 800 is shown. The long flush sequence 800 is initiated when the long flush button 72 is pressed according to step 802. Once the control board 28 detects the operation of the long flush button 72, the control board 28 instructs the various components to perform a pre-rinse, rinse, and fill of the bowl 16.

The pre-rinse cycle begins with the control board 28 instructing the rim supply valve 54*a* to open and then close according to step 804 to pre-rinse the bowl 16. This pre-rinse cycle may remove debris, such as toilet paper, stuck on the walls of the bowl 16 above the water fill line. Only a small of amount of water may be used to perform the pre-rinse of the bowl 16.

Next, according to step 806, the flush valve 26 is opened to remove waste from the bowl 16 while the rim supply valve 54*a* remains closed. This is a short, water efficient step, which removes the waste from the bowl 16. The flush valve 26 is then closed to seal the bowl opening 20 of the bowl 16 according to step 808.

Once the pre-rinse cycle is completed, the rinse cycle begins. After the flush valve 26 closed, the rim supply valve 54*a* is opened according to step 810 to start the bowl rinse cycle. After a sufficient amount of water has been introduced into the bowl 16, the flush valve 26 is opened according to step 812 to evacuate the water accumulated during the rinse cycle from the bowl 16. While the flush valve 26 is opened, water may continued to be supplied to the rim 18 to rinse the bowl 16. After a period of time, the flush valve 26 is closed according to step 814 to seal the bowl 16 and the rim supply valve 54*a* is closed according to step 816 to end the bowl rinse cycle.

Notably, while the rim supply valve 54*a* is opened and supplying water to the rim 18 via the rim line 60 either during the pre-rinse cycle or the rinse cycle, the eductor 64 may be used to increase the rate at which water is supplied to the rim 18. As the water introduced from the tank 56 to the rim line 60 via the eductor line 62 increases the flow rate of the rinse water into the bowl rim 18, the water is supplied more quickly and in such a manner as to more effectively and efficiently rinse the bowl 16. At greater flow rates, better bowl rinsing can be performed more quickly and with less water than with eductor-less flush mechanisms.

After the bowl rinse cycle is complete, then the fill cycle begins to refill the bowl 16 for another use of the toilet 10. During the fill cycle, the fill valve 54*b* is open and then closed according to step 818 to supply water to the water tank 56 (which may have been partially or fully depleted during the pre-rinse and rinse cycles) and to re-fill the bowl 16. The fill valve 54*b* remains open until the bowl 16 and the tank 56 are refilled. The determination of the levels of water in the bowl 16 and tank 56 may be determined by the water level sensor 48 and the float switch 66, respectively. Of course, a stop condition for refilling the bowl could potentially be based on one of or both of the water level sensor 48 and the float switch 66 or could be based on some other sensor or timing mechanism.

It should be appreciated that during the fill cycle, the rim supply valve 54*a* may be closed and, accordingly, the rate of flow of water into the bowl 16 may be comparatively slower than during the pre-rinse and/or rinse cycle. Of course, depending the particular plumbing configuration, the bowl re-fill may be accomplished using an additional bowl fill valve or by using the rim supply valve 54*a* either alone or in combination with the fill valve 54*b*.

Figure 9:
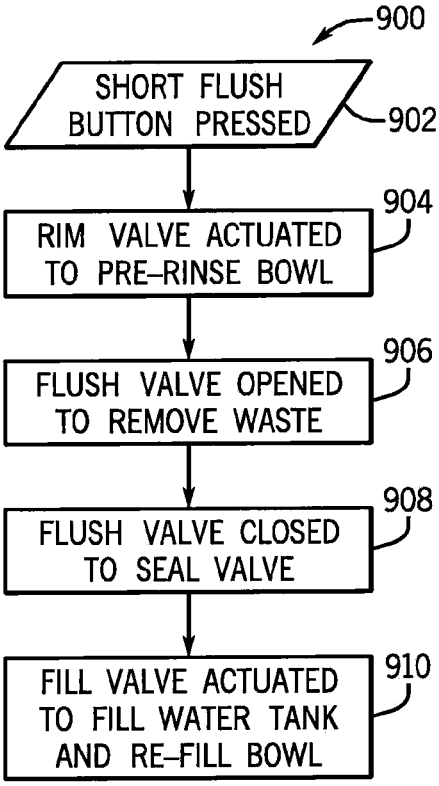
FIG. 9 is a process chart of a short flush sequence for the toilet of FIG. 1.

Referring now to FIG. 9, a short flush sequence 900 is illustrated which may be generally used for the elimination of light or low waste, such as urine or perhaps small amounts of bath tissue, from the bowl 16. Upon pressing the short flush button 70 according to step 902, the short flush sequence 900 is initiated. First, a pre-rinse cycle occurs in which the rim supply valve 54*a* is open and then closed according to step 904 to supply a shot of water to the rim 18 and clear any waste or debris from the walls of the bowl 16. Next, the flush valve 26 is opened to remove the water and waste from the bowl 16 via the trapway 24 according to step 906. After the water and waste are eliminated from the bowl 16, the flush valve 26 is closed according to step 908. The fill valve 54*b* is then open and closed to re-fill the water in the bowl 16 and the tank 56 according to step 910. Of course, as described above, the re-fill step may be achieved by opening the fill valve 54*b* or by opening one or more other valves to fill the tank 56 and bowl 16.

Thus, a toilet is disclosed that is capable of performing two flush sequences. The longer of the two flush sequences is engineered with the removal of solid waste or the like from the bowl. The shorter of the two flush sequences is engineered with the removal of light waste or the like from the bowl. Given the benefits of water conservation, these flush sequences aim to use an appropriate amount of water for the task at hand.

Further, these flush sequences may utilize a pre-rinse cycle which helps to more efficiently use the water of the flushing sequence. In contrast to conventional flush cycles, which may have water continuously fed to the bowl via the rim while water continually drains from the bowl opening, the rim supply valve 54*a* may be opened and closed to provide an initial shot of water to pre-rinse the walls and then opened again after the bowl has been evacuated. By shutting off the rim supply valve in between the pre-rinse cycle and the subsequent rinse cycle, the amount of water used over the flush cycle is reduced.

While a specific embodiment of the present invention has been shown, various modifications falling within the breadth and scope of the invention will be apparent to one skilled in the art. For example, one or more jets may assist in vacating water and waste from the bowl. Thus, the following claims should be looked to in order to understand the full scope of the invention.

INDUSTRIAL APPLICABILITY

Disclosed is a plumbing fixture, such as a toilet having an advanced flush control assembly and sequencing providing efficient water consumption with adequate rinsing of the bowl.

What is claimed is:

1. A toilet comprising:

a bowl;

a flush valve configured to control flow from the bowl; and a supply valve configured to control flow to the bowl;

wherein the flush valve and the supply valve are configured such that during a flush sequence the supply valve and the flush valve are both opened and closed twice, first during a pre-rinse cycle and subsequently during a rinse cycle, the supply valve and the flush valve being closed at a start and end of the cycles and open between the start and end of the cycles.

2. The toilet of claim 1, further comprising:

an eductor coupled to the supply valve;

wherein the supply valve is configured to direct water from the eductor to the bowl.

3. The toilet of claim 1, wherein the bowl comprises a rim; and wherein the supply valve is a rim supply valve configured to direct water to the bowl via the rim.

4. The toilet of claim 1, further comprising:

an electronic controller configured to control operation of the supply valve and the flush valve based on a selection of a flush sequence received from a user.

5. The toilet of claim 4, further comprising:

a water supply reservoir having a filler;

wherein the electronic controller is configured to control operation of the filler.

6. The toilet of claim 4, wherein the controller is configured to control operation of the filler based at least in part on input signals received from a water level sensor.

7. The toilet of claim 4, further comprising:

a bowl water level sensor configured to sense a water level within the bowl;

wherein the electronic controller is configured to control operation of the flush valve based on inputs received from the bowl water lever sensor.

8. A toilet, comprising:

a bowl having an outlet;

a flush valve configured to control flow through the bowl outlet; and a supply valve configured to control flow into the bowl;

wherein the toilet is selectively operable in first and second flush sequences, wherein upon the first flush sequence being initiated, the flush valve opens and closes once, and upon the second flush sequence being initiated, the flush valve opens and closes twice.

9. The toilet of claim 8, wherein in the first flush sequence the supply valve opens and closes once, and in the second flush sequence the supply valve opens and closes twice.

10. The toilet of claim 9, wherein the supply valve is a rim supply valve configured to control the flow of fluid to a rim of the bowl.

11. The toilet of claim 10, further comprising:

an eductor;

wherein the rim supply valve is configured to receive fluid from the eductor.

12. The toilet of claim 7, further comprising:

an electronic controller configured to control operation of the supply valve and the flush valve.

13. The toilet of claim 9, wherein the flush valve and the supply valve are configured such that the second flush sequence, the supply valve opens and closes a first time prior to the flush valve opening and closing a first time.

14. The toilet of claim 10, further comprising:

a water level sensor mounted in the bowl and coupled to the electronic controller for sending bowl level input signals to the electronic controller.

15. The toilet of claim 11, further comprising:

a supply water sensor mounted at a water supply reservoir and coupled to the electronic controller for sending reservoir level input signals to the electronic controller.

16. A method of operating a toilet, the toilet comprising a supply valve and a flush valve both fluidly coupled to a bowl, the method comprising:

receiving a selection to initiate one of a first flush sequence and a second flush sequence from a user;

based on the selection, performing one of the first flush sequence and the second flush sequence;

wherein performing the first flush sequence comprises opening and closing the supply valve once; and wherein performing the second flush sequence comprises opening and closing the supply valve twice.

17. The method of claim 16, wherein performing the first flush sequence further comprises opening and closing the flush valve once; and wherein performing the second flush sequence further comprises opening and closing the flush valve twice.

18. The method of claim 12, wherein performing the second flush sequence comprises opening and closing the supply valve a first time prior to opening and closing the flush valve a first time.

19. The method of claim 16, further comprising monitoring a water level within the bowl of the toilet, and opening the flush valve based on the water level.

20. The method of claim 16, further comprising supplying water to the supply valve via an eductor.

* * * * *